United States Patent [19]

Kempf

[11] 4,075,445

[45] Feb. 21, 1978

[54] THREAD MONITORING SWITCH FOR TEXTILE MACHINES HAVING MAGNET BIASING LEVER TO PREVENT ANY ANNOYING THREAD FLUTTER

[75] Inventor: Gerhard Kempf, Arbon, Switzerland

[73] Assignee: Evolution SA, Rorschach, Switzerland

[21] Appl. No.: 676,667

[22] Filed: Apr. 14, 1976

[30] Foreign Application Priority Data

Apr. 15, 1975 Germany ..... 2516488

[51] Int. Cl.[2] ..... B65H 25/14

[52] U.S. Cl. ..... 200/61.18; 28/188; 57/81; 66/163; 242/37 R

[58] Field of Search ..... 200/61.13, 61.18; 57/81; 242/37 R; 66/160–163; 19/.25, .26; 139/353; 28/187, 188

[56] References Cited

U.S. PATENT DOCUMENTS

| | | | |
|---|---|---|---|
| 2,734,334 | 2/1956 | Saunders | 242/37 R X |
| 3,253,269 | 5/1966 | Ratti | 200/61.18 X |
| 3,438,188 | 4/1969 | Boggs | 242/37 R X |
| 3,701,247 | 10/1972 | Rehn et al. | 57/81 |

*Primary Examiner*—James R. Scott
*Attorney, Agent, or Firm*—Karl F. Ross

[57] ABSTRACT

A filament supplied to a textile machine is held under tension by a thread mounted on a weighted or otherwise biased lever which trips a switch to arrest the machine upon rupture of the filament. In normal operation, the lever is held against a stop by the tension of the thread supplemented by the force of a magnet whose attraction diminishes rapidly over the swing range of the lever, the biasing force slightly exceeding the magnetic force in the normal lever position to prevent oscillations in response to minor fluctuations in filament tension but to initiate a rapid cutoff in the event of a break.

10 Claims, 4 Drawing Figures

THREAD MONITORING SWITCH FOR TEXTILE MACHINES HAVING MAGNET BIASING LEVER TO PREVENT ANY ANNOYING THREAD FLUTTER

FIELD OF THE INVENTION

My present invention relates to a device for monitoring the continuity of filament such as a thread or yarn continuously supplied to a textile machine.

BACKGROUND OF THE INVENTION

Such monitoring devices are known per se, e.g. from Swiss Pat. No. 518,231. Basically, they operate by biasing a feeler such as a movable thread guide against the stretched filament which normally prevents the feeler from actuating an alarm switch designed to alert the operator to a rupture of the filament and/or to arrest the associated textile machine automatically. This mode of operation makes it necessary to keep the filament under a certain tension so as to prevent a malfunction in the event of a temporary slackening of the thread.

If the feeler has a relatively large moment of inertia, short-term fluctuations in thread tension will not give rise to an untimely alarm condition. With high-speed machinery, such a slow-moving feeler cannot respond quickly enough to the final unwinding of the thread from its supply spool to signal the need for a replacement before the end of the thread has disappeared into the machine. Insertion of a new thread, however, is more easily accomplished if the trailing end of the old one is still within reach.

OBJECT OF THE INVENTION

The object of my present invention, therefore, is to provide an improved monitoring device of the character described in which the aforestated disadvantages are avoided.

SUMMARY OF THE INVENTION

A thread monitor according to my present invention, in which a tension-sensing member movable on a fixed support between a normal position (defined by a stop on the support) and an off-normal position carries thread-guiding means for holding the surveyed filament under tension with the aid of biasing means tending to displace that member from its normal position, comprises magnetic means exerting upon the movable member a retaining force supplementing the filament tension in opposing the biasing means, this retaining force being less than the biasing force in the normal position and diminishing to substantially zero within the range of displacement of the movable member for rapid operation, in the event of filament rupture, of switch means designed to arrest the associated textile machine.

In the embodiment specifically described hereinafter, the magnetic means comprises a permanent magnet on the support and a coacting armature forming part of the movable sensing member. It will be understood, however, that the mode of operation will be the same if the position of these two elements is reversed, i.e. if the movable member carries the magnet and the armature is secured to the fixed support. In either case, the magnetic force developed between the two elements diminishes with the square of the intervening distance and thus decays very rapidly to practically zero. In the case of a true filament rupture, as distinct from a mere temporary slackening, a point is soon reached where the speed of that member is determined practically exclusively by its moment of inertia possibly supplemented by a reactive force resisting the operation of the controlled switch. The moment of inertia can therefore be made as low as desired without risking a false alarm.

BRIEF DESCRIPTION OF THE DRAWING

The above and other features of my invention will now be described in detail with reference to the accompanying drawing in which.

SPECIFIC DESCRIPTION

Figure 2:
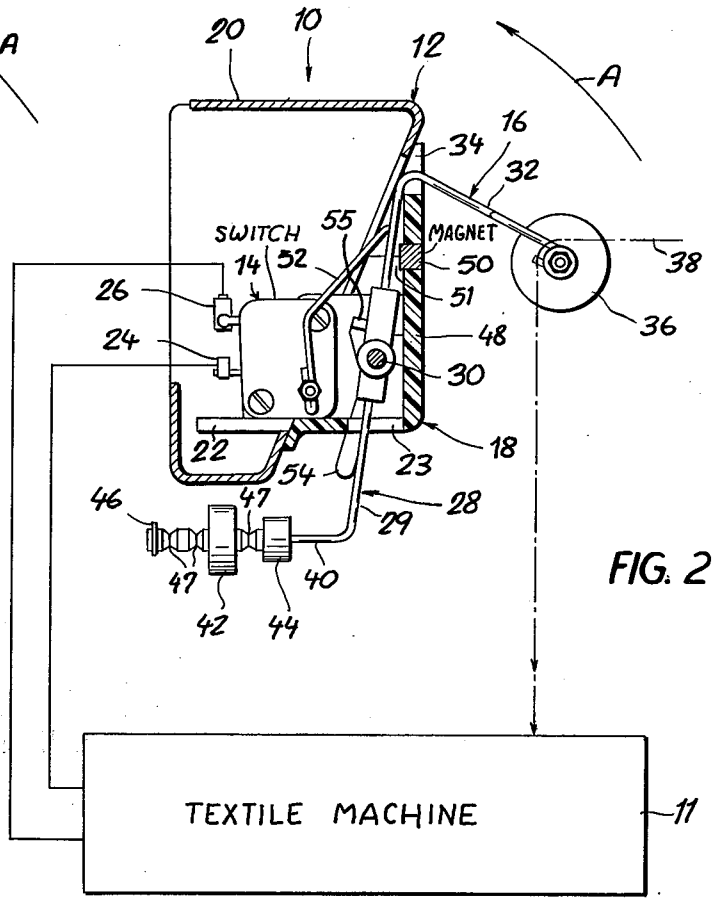
FIG. 2 is a partly diagrammatic cross-sectional view taken on the line II — II of FIG. 1.
Figure 1:
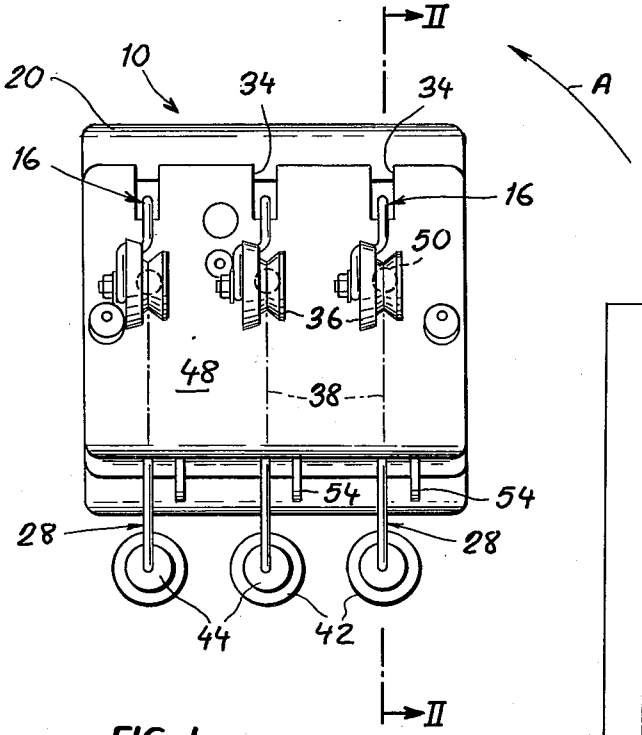
FIG. 1 is a front view of a thread monitor according to my invention.

The monitoring device shown in the drawing, generally designated 10, comprises a housing 12 enclosing a sensitive switch 14 with terminals 24 and 26 in a control circuit of a conventional textile machine 11 (FIG. 2). Housing 12, serving as a fixed support for a movable tension-sensing member 28 fulcrumed to it at a pivot 30, comprises a bracket 18 of synthetic resin overlain by a sheet-metal lid 20, the housing being open toward the rear. A horizontal leg 22 of bracket 18 carries the switch 14 and has an aperture 23 traversed by the movable member 28 which is shown as a generally Z-shaped lever with a substantially upright stem 29, an upper extremity 32 and a lower extremity 40. In the illustrated embodiment, three identical levers 28 are independently swingable about the common pivot 30 and carry respective thread-guiding rollers 36 engaged by filaments 38 which pass under tension to spindles, bobbins or the like within machine 11 from nonillustrated supply spools.

Figure 3:
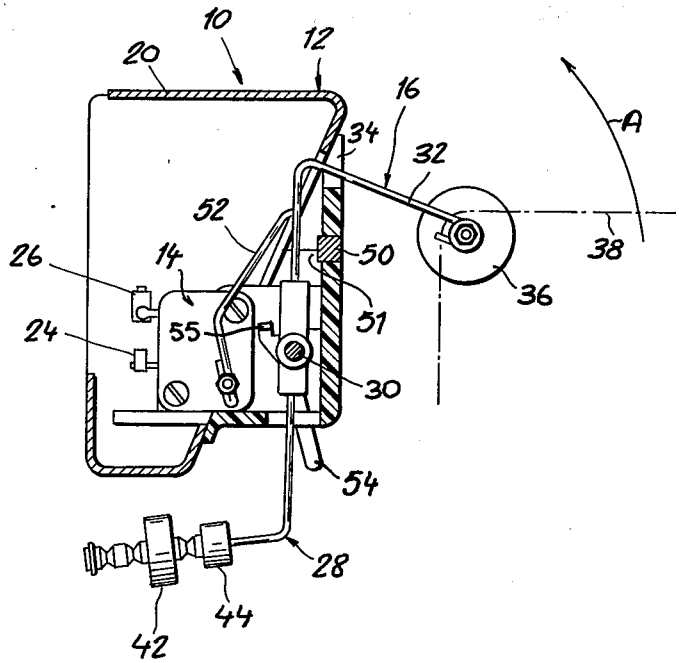
FIG. 3 is a view similar to FIG. 2, showing the device in a near-normal position.

Switch 14 has an arm 52 which bears under light spring pressure upon all three levers 28 and normally, in the positions illustrated in FIGS. 2 and 3, keeps the machine 11 operating. The vertical leg 48 of bracket 18 is formed with three recesses 34 traversed by the upper lever extremities 32, the stem 29 normally coming to rest against the bottom edges of these recesses which thus constitute a stop defining the normal position shown in FIG. 2.

Figure 4:
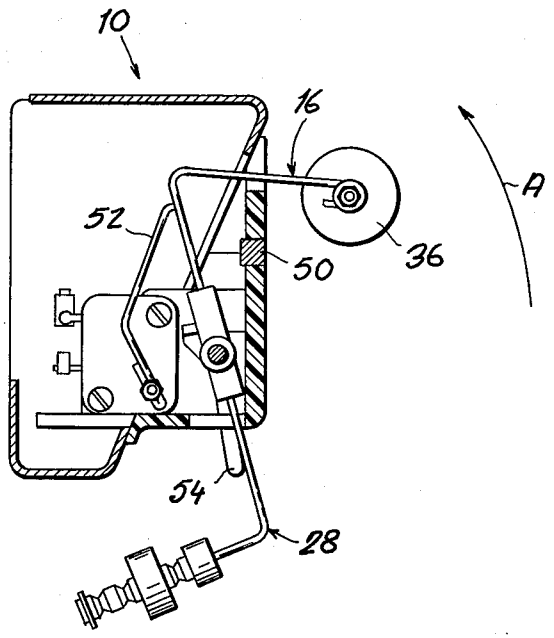
FIG. 4 is another view similar to FIG. 2, showing the device in an off-normal position indicative of thread rupture.

Each lever extremity 40 carries a weight 42 which is displaceable thereon between two abutments 44 and 46 and may be indexed in one of several notches 47 to provide an adjustable biasing force tending to swing the lever counterclockwise (arrow A) as viewed in FIGS. 2 and 4, thereby maintaining the corresponding thread 38 under a certain tension. Three permanent magnets 50 in housing wall 48 respectively confront the levers 18 above their pivot 30, tending to prevent any counterclockwise swing thereof by attracting the stems 29 against the aforementioned stops which maintain a gap 51 between the stems and the magnets; these stems are, of course, made of steel or other ferromagnetic material to act as armatures for the magnets 50. The magnetic force across the narrow gap 51 is strong enough to hold the lever in position, against the torque exerted on it by the weight 42, even if the tension of thread 38 is low. If that tension falls below a predetermined minimum, adjustable by the setting of weight 42, the lever begins to swing away from housing wall 48 at an accelerating rate as the magnetic attraction diminishes. In the near-normal position of FIG. 3, in which the switch 14 is still closed, that attactive force has dropped to a small fraction of its original value; if the filament 38 is still intact, a subsequent increase in its tension restores the normal position of FIG. 2 without arresting the machine 11 or giving any alarm signal. Otherwise, i.e. if the thread 38 is ruptured or has run off its supply spool, lever 28 continues to swing into the position of FIG. 4 in which the circuit of the thread-winding spindles or the like within machine 11 is interrupted by the switch 14.

The presence of the gap 51 prevents the ferromagnetic lever stem 29 from clinging to magnet 50 upon failure of filament tension.

In some instances it will be desirable to deactivate one or more of the tension-sensing levers 28, as when the corresponding guide roller or rollers 36 are not in use, in order to let the remaining lever or levers control the switch 14. For this purpose, according to another feature of my invention, the pivot 30 of each lever is shown to have mounted theron a detent 54 in the form of a swingable handle which may be displaced in slot 23 from an inactive position (FIGS. 3 and 4) into a working position (FIG. 2) in which a projection 55 on that handle engages the lever 28 and holds it against its stop on wall 48. Handle 54 may be frictionally retained in its working position or indexed in that position by means not shown.

Thus, my improved thread monitor effectively discriminates between temporary and permanent loss of tension and, in the latter case, rapidly trips the controlled switch 14 to halt the machine 11. Its retarded initial response to a loss of tension prevents any annoying thread flutter observed with conventional devices of this type.

I claim:

1. A device for monitoring the passage of a filament to a machine, comprising:

a fixed support;

a movable member mounted on said support and provided with thread-guiding means thread-guiding means for holding said filament under tension;

stop means on said support defining a normal position for said member;

switch means on said support operable by said member in an off-normal position thereof to arrest said machine upon rupture of said filament;

biasing means tending to displace said member from said normal position to said off-normal position agains the tension of said filament; and magnetic means disposed in part on said member and in part on said support for exerting upon said member a retaining force supplementing the tension of said filament in opposing said biasing means, said retaining force being less than the force of said biasing means in said normal position and diminishing to substantially zero within the range of displacement of said member for rapid operation of said switch means by said member in the event of filament rupture.

2. A device as defined in claim 1 wherein said magnetic means comprises a magnet element and an armature element, one of said elements being rigid with said member, the other of said elements being mounted on said support, said stop means maintaining a predetermined gap between said elements in said normal position.

3. A device as defined in claim 2 wherein said magnet element is mounted on said support, said armature element being an integral part of said member.

4. A device as defined in claim 1 wherein said member is a lever fulcrumed on said support.

5. A device as defined in claim 4 wherein said thread-guiding means is mounted on one end of said lever, said biasing means comprising a weight on an opposite end of said lever.

6. A device as defined in claim 5 wherein said weight is displaceable on said opposite end for adjusting the biasing force.

7. A device as defined in claim 6 wherein said opposite end is provided with indexing formations for holding said weight in different positions of adjustment.

8. A device as defined in claim 4 wherein said lever is generally Z-shaped with a substantially upright stem, an upper extremity carrying said thread-guiding means and a lower extremity carrying said weight.

9. A device as defined in claim 8 wherein said switch means comprises an arm normally bearing upon said stem in aiding relationship with said retaining force.

10. A device as defined in claim 1, further comprising detent means on said support movable into engagement with said member for arresting same in said normal position.

* * * * *